US009317013B2

(12) United States Patent
Kaelin et al.

(10) Patent No.: US 9,317,013 B2
(45) Date of Patent: Apr. 19, 2016

(54) METHOD OF PRODUCING DRIVE ELEMENT FOR A TIMEPIECE BARREL INCLUDING A BARREL ARBOR AND MAINSPRING

(71) Applicant: ETA SA Manufacture Horlogere Suisse, Grenchen (CH)

(72) Inventors: Laurent Kaelin, Sonvilier (CH); Arthur Queval, Lutry (CH); Marco Rochat, Le Brassus (CH); Thierry Conus, Lengnau (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 421 days.

(21) Appl. No.: 13/869,480

(22) Filed: Apr. 24, 2013

(65) Prior Publication Data

US 2013/0283615 A1 Oct. 31, 2013

(30) Foreign Application Priority Data

Apr. 25, 2012 (EP) ..... 12165537

(51) Int. Cl.
*G04B 1/16* (2006.01)
*G04B 1/18* (2006.01)

(52) U.S. Cl.
CPC .. *G04B 1/16* (2013.01); *G04B 1/18* (2013.01); *Y10T 29/49581* (2015.01)

(58) Field of Classification Search
CPC ..... G04B 1/14; G04B 1/16; G04B 1/18; Y10T 29/49581; Y10T 29/49579
See application file for complete search history.

(56) References Cited

U.S. PATENT DOCUMENTS

| | | | | |
|---|---|---|---|---|
| 820,252 | A | 5/1906 | Wilson | |
| 3,844,108 | A * | 10/1974 | Bachmann | G04B 11/024 368/154 |
| 3,846,974 | A | 11/1974 | Giger | |
| 4,077,201 | A | 3/1978 | Perrot | |
| 2009/0086584 | A1 * | 4/2009 | Takahashi | G04B 9/02 368/148 |

FOREIGN PATENT DOCUMENTS

| | | |
|---|---|---|
| CH | 117808 | 12/1926 |
| FR | 2 329 000 | 5/1977 |

OTHER PUBLICATIONS

European Search Report issued Dec. 20, 2012, in European Patent Application No. 12165537.7, filed Apr. 25, 2012.

* cited by examiner

*Primary Examiner* — Sarang Afzali
(74) *Attorney, Agent, or Firm* — Oblon, McClelland, Maier & Neustadt, L.L.P.

(57) ABSTRACT

A method for fabricating a barrel arbor for a timepiece includes wire drawing a bar to form a continuous profile, projecting or re-entrant relative to a support sector having a touching-up axis parallel to the bar axis, and whose section matches that of complementary hooking to be made on the arbor and, in a touching-up operation, machining the complete external contour of the arbor. A drive element includes a determined spiral-coiled mainspring including at an inner end hooking having a defined profile and an arbor produced by this method including the support sector for supporting the first coil, and a complementary hooking having a complementary profile to the profile for pivoting together with the mainspring.

15 Claims, 13 Drawing Sheets

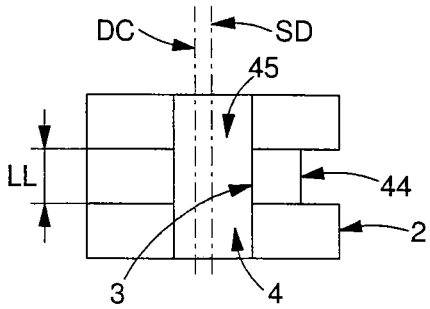
Fig. 9A
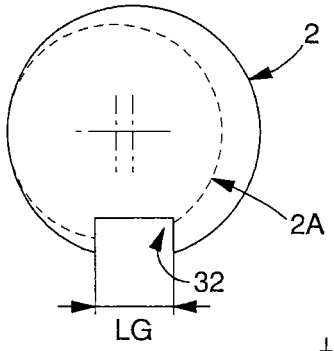
Fig. 9B
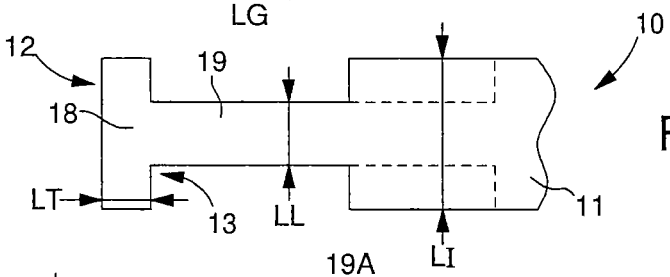
Fig. 9C
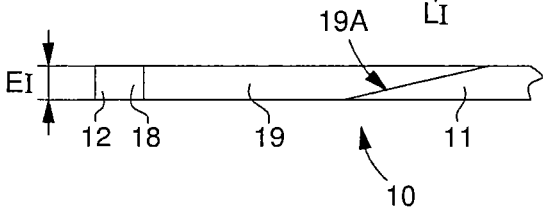
Fig. 9D
Fig. 16C
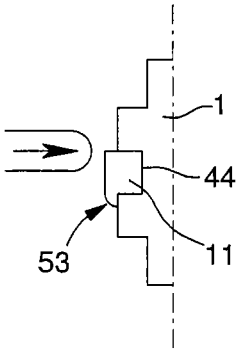
Fig. 16D
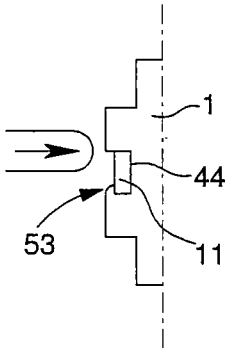
Fig. 5C
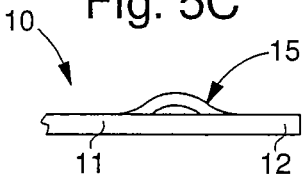
Fig. 5D
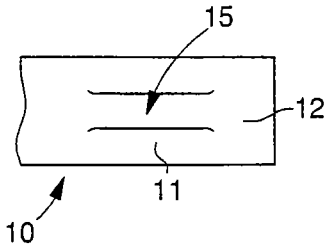

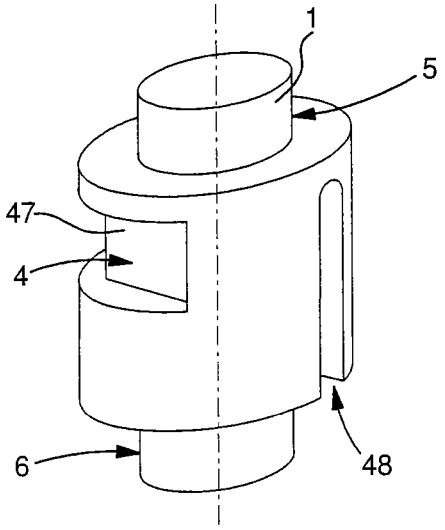
Fig. 11A
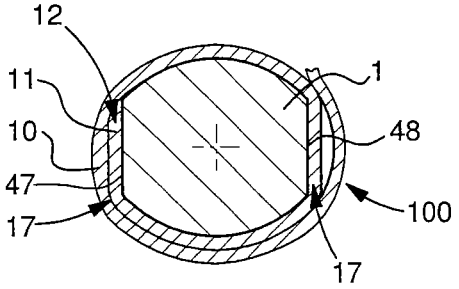
Fig. 11B
Fig. 10A
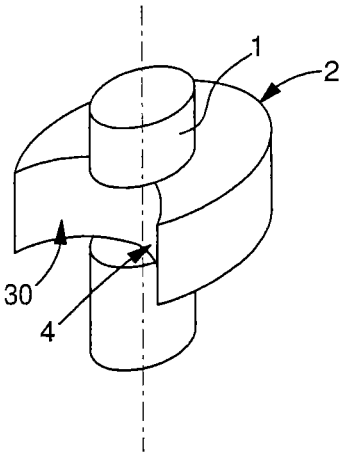
Fig. 10B
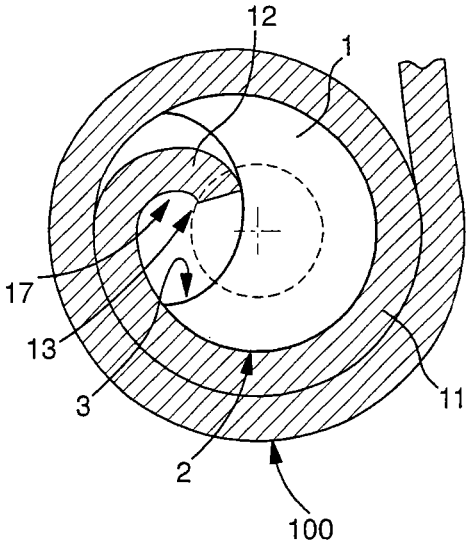

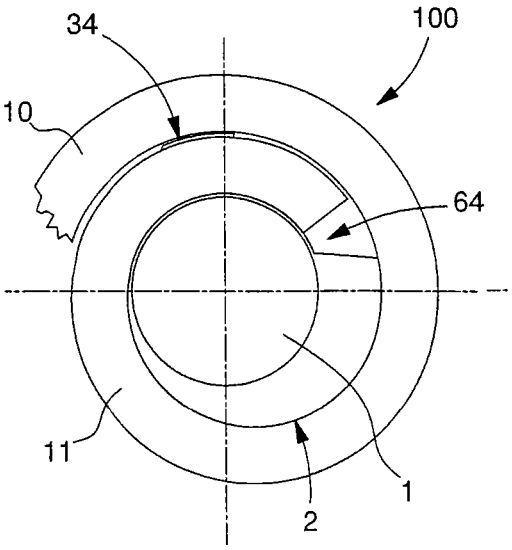
Fig. 27
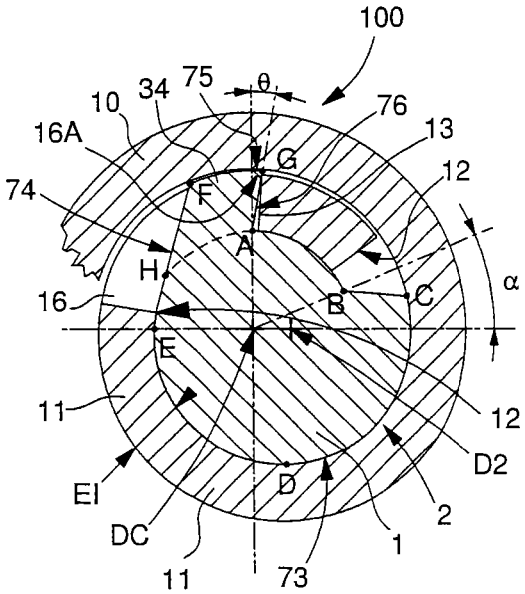
Fig. 28
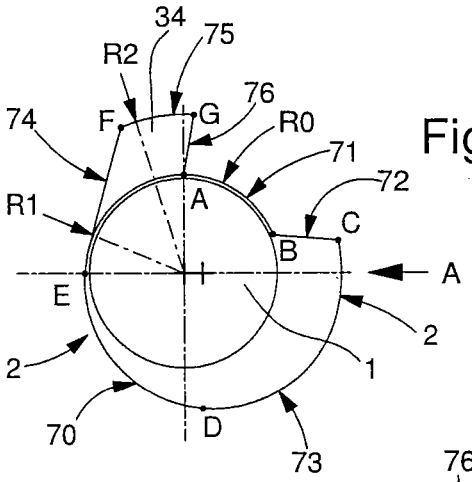
Fig. 29
Fig. 31
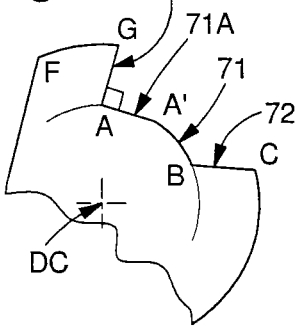
Fig. 32
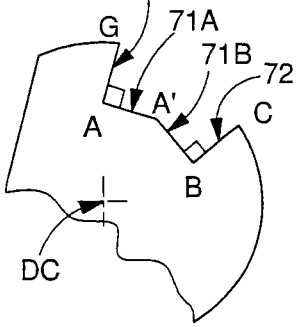
Fig. 30
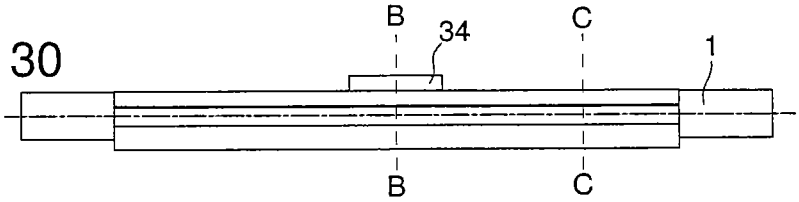

METHOD OF PRODUCING DRIVE ELEMENT FOR A TIMEPIECE BARREL INCLUDING A BARREL ARBOR AND MAINSPRING

This application claims priority from European Patent Application No. 121655537.7 filed Apr. 25, 2012, the entire disclosure of which is incorporated herein by reference.

FIELD OF THE INVENTION

The invention concerns a method of manufacturing a timepiece barrel arbor.

The invention also concerns a drive element for a timepiece barrel, comprising at least, on the one hand, a spiral strip mainspring of determined type comprising a first inner coil of defined width and thickness, said first inner coil comprising, at an inner end, a holding or hooking means of defined profile for holding the first coil on a barrel arbor, and said drive element comprising, on the other hand, a barrel arbor of this type.

The invention also concerns a timepiece movement including at least one drive element of this type.

The invention concerns the field of horology, and more specifically the field of drive mechanisms.

BACKGROUND OF THE INVENTION

Any increase in capacity of timepiece drive mechanisms is limited by the volume available for the barrels comprising the energy storage springs. The available volume is delimited by the space available in the movement, and thus by the size of the drum incorporating the mainspring, and by the geometry of the barrel arbor which must be sized to transmit the maximum torque safely.

U.S. Pat. No. 3,846,974 A in the name of ETA discloses a barrel with drawn longitudinal grooves, for supporting the mainspring and hook. U.S. Pat. No. 820 252A in the name of PORTER WILSON discloses a similar arrangement.

U.S. Pat. No. 3,846,974A in the name of GIGER discloses a barrel with a very simple cylindrical arbor, having grooves drawn along generatrices, carrying the mainspring and ratchet. The ratchet has an inclined toothing to hold the arbor axially.

SUMMARY OF THE INVENTION

The invention proposes to improve the capacity of timepiece barrels, by employing barrel arbors with the smallest possible diameters, to increase the volume allowed for the mainspring, or to the mainsprings if there are several, and thus to increase the power reserve of such barrels.

It is not sufficient to apply a scale factor to existing barrel arbors, since the rigidity of the arbor must be guaranteed, or increased relative to usual arbor diameters, because of the greater torque that can be applied by the mainspring.

Therefore, methods should be chosen which guarantee good resistance of the arbors to bending and to fatigue while remaining at an acceptable cost. The morphology of the arbor determines the manner in which the mainspring is secured to the arbor, which must be reliable to prevent any unnecessary disassembly. All things being otherwise equal, particularly as regards the materials and thermal treatments used to make the arbors and mainsprings, it is the shape of the arbor, the shape of the mainspring, but also the type of assembly between the mainspring and the arbor, which determines the perfect behaviour of the drive element that they form together. A reduction, by a significant factor, in the arbor diameter relative to conventional manufacture, also requires a reduction in the radius of curvature of the first inner coil of the mainspring and the subsequent coils. The combined concept of the arbor, the associated mainspring and the way in which they are secured or driven, must take account of this constraint, to prevent any triangulation or faceting of the inner coils of the mainspring, which would reduce the life of said mainspring.

The invention therefore concerns a method of producing a drive element for a timepiece barrel, comprising, on the one hand, at least one spiral strip mainspring of determined type comprising a first inner coil with a defined first width and first thickness, said first inner coil comprising, for the holding thereof on a barrel arbor, at an inner end, a holding or hooking means having a determined profile, said drive element further comprising a barrel arbor, characterized in that, to make said arbor, in a first wire drawing operation, a bar is drawn so as to form, about an axis parallel to the drawing direction, a progressive profile in the shape of a snail between a smallest radius and a largest radius, with a step between the points of said largest radius and smallest radius, said profile in the shape of a snail comprising a support sector for said inner coil, and in that, in a second touching-up or turning operation of said drawn bar about a touching-up axis parallel to or merged with the drawing direction, the complete external contour of said arbor, comprising at least one cylindrical shoulder for the pivotal guiding of said arbor, is machined or turned, said step being used, either as a stop means for said means of holding or hooking said mainspring when said step is used as drawn, or as a complementary stop or hooking means for said mainspring holding or hooking means when said step is re-machined during said second touching-up or bar turning operation, and in that, in said second touching-up operation, a groove is machined, of revolution about a touching-up axis parallel to the drawing direction, and the width of which is adjusted along the direction of said touching-up axis, to hold in position said inner coil of said mainspring in the direction of said touching-up axis, on at least one point on the revolution thereof, said groove being secant with said step, between the surfaces thereof of smaller radius and of larger radius, and said groove being substantially tangent to said profile in the shape of a snail in a zone substantially diametrically opposite to said step relative to said touching-up axis of revolution of said groove.

According to a feature of the invention, at least one portion of said support sector is given a superficial roughness, greater than 12 Ra micrometers, in the form of a flute made during said wire drawing operation.

According to a feature of the invention, at least one portion of said support sector is given a superficial roughness, greater than 12 Ra micrometers, in the form of a milled portion made during said wire drawing operation.

BRIEF DESCRIPTION OF THE DRAWINGS

Other features and advantages of the invention will appear upon reading the following detailed description, with reference to the annexed drawings, in which:

FIGS. 5C and 5D illustrate, in a side view and a top view, the inner end of a mainspring stamped to create, between parallel slots along the elongation of said mainspring, at least one folded median lug forming a projecting boss relative to the rest of the mainspring surface.

FIG. 9A is an elevation view of an arbor showing a groove along a generatrix secant with a groove of revolution off-centre relative to the barrel axis. FIG. 9B is an upper view of this arbor. FIG. 9C is an elevation of the end of the associated mainspring, comprising a T-shaped end, and FIG. 9D is the corresponding top view, showing a chamfer on the inner face.

FIG. 10A shows a schematic, perspective view of an arbor comprising a recess with curved radius. FIG. 10B shows a cross-section perpendicular to the barrel arbor of the same arbor provided with a mainspring whose inner end is wound onto a small radius, and housed in said recess.

FIG. 11A shows a schematic perspective view of an arbor comprising, substantially parallel to each other, a flat portion and a slot housing the inner coil of the mainspring. FIG. 11B shows a cross-section perpendicular to the barrel axis, said arbor being provided with a mainspring whose inner end abuts on the flat portion and is then slid into the slot.

FIG. 16C shows a schematic cross-section passing through the axis of a mainspring mounted to project into a circular groove, and subjected, on the top side, to the action of a thumb wheel to deform the edge thereof, the lower edge being shown with a deformation surface resulting from the action of said thumb wheel on the mainspring, whereas FIG. 16D illustrates, in a similar manner, which is preferred in the usual case where the hardness of the mainspring is greater than that of the arbor, wherein the thumb wheel is applied to the walls of a groove in which the mainspring is clamped to trap said mainspring underneath the deformation zones.

FIGS. 27 to 30 illustrate an embodiment having a profile well suited to an arbor of very small diameter:

FIG. 27 shows a schematic, end view of a barrel drive element with a progressive profile in the shape of a snail, carrying a mainspring.

FIG. 28 is a transverse cross-section of the drive element of FIG. 27 in a plane passing through a hook comprised in the arbor.

FIG. 29 is an end view showing only the arbor of the assembly.

FIG. 30 is a side view of the same arbor in direction A of FIG. 29.

FIGS. 31 and 32 partially illustrate two variants of the arbor profile in the area receiving the inner end of the mainspring.

DETAILED DESCRIPTION OF PREFERRED EMBODIMENTS

Figure 1:
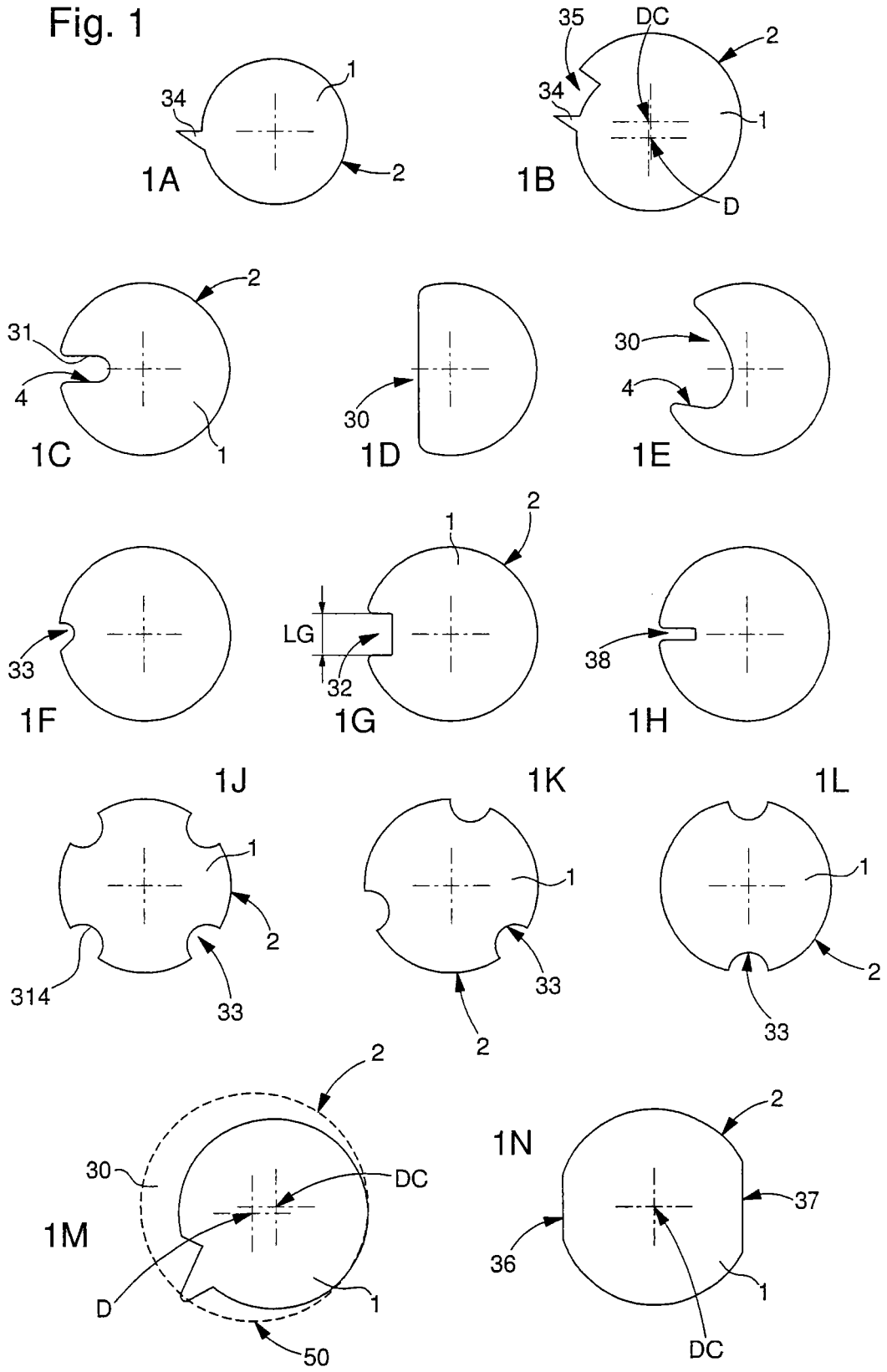
FIGS. 1A through 1H and FIGS. 1J through 1N show a schematic cross-section, perpendicular to a bar direction, of various variants of wire drawn bar sections for making timepiece barrel arbors.

The invention concerns a method of producing a drive element 100 for a timepiece barrel, comprising at least one spiral strip mainspring 10 of determined type comprising a first inner coil 11 having a defined first width LI and first thickness EI. This first inner coil 11 comprises, for the holding thereof on a barrel arbor 1, at an inner end 12, a holding or hooking means 13 having a defined profile 14. This profile 14 may take various forms, particularly a stamped or machined eyelet, a fold made by folding an edge made by rolling, a boss, a notching, a projecting element, or a cut-out portion, or simply a cylindrical profile for the proper local support of mainspring 10 on arbor 1 at a determined point, of the same radius of curvature, so as to secure said mainspring and arbor to each other by laser welding, welding, brazing, bonding or similar. Drive element 10 further includes a barrel arbor 1.

According to the invention, to produce this arbor 1, in a first wire drawing operation, a bar is wire drawn to make, about an axis parallel to the direction of wire drawing, a profile 30 whose section perpendicular to the wire drawing direction is a snail shape changing between a smaller radius R1 and a larger radius R2 with a step 60 between a projecting point 61 of larger radius R2 and a re-entrant point 62 of smaller radius R1. With a zone 63 of smaller radius R1, this step 60 delimits a recess 64 about a re-entrant point 62. This recess 64 is used in various ways according to the method of securing mainspring 10, as will be explained below. This snail-shaped profile 30 has, on at least one portion of the circumference thereof, a support sector 2 for the inner coil 11 of mainspring 10.

In a second operation of touching-up or bar turning the wire drawn bar about a touching-up axis DC parallel to the direction of drawing, the complete external contour of arbor 1 is machined or turned. This complete contour includes at least one cylindrical shoulder 5, 6 for pivotally guiding arbor 1. When step 60 is used as drawn, step 60 is used as a stop means for holding or hooking means 13 for mainspring 10. Or, when said step 60 is machined again during this second touching-up or bar turning operation, step 60 is used as complementary stop or hooking means 3 for holding or hooking means 13 for mainspring 10.

In a first variant implementation of the invention, holding or hooking means 13 for mainspring 10 is limited to at least one support surface 65 of given curvature. The inner end 12 of mainspring 10 is positioned in recess 64, abutting on step 60, or in proximity thereto. The inner coil 11 extends away from step 60 and abuts on an ever increasing radius of arbor 1. Mainspring 10 is thus wound onto arbor 1 on the side of recess 64 relative to step 60. Mainspring 10 is irreversibly secured to arbor 1, particularly by laser welding, welding, brazing, bonding or similar, between the inner support surface 65 of mainspring 10 and the zone 63 of smaller radius R1. This irreversible securing may be achieved in a point, or in a network of points, or along a generatrix or similar. In a particular embodiment, the securing method is repeated on another area of the arbor, for example substantially diametrically opposite relative to zone 63 of smaller radius R1. In this first variant, the difference between the smallest radius R1 and the largest radius R2 is substantially equal to the thickness EI of mainspring 10, or at least to the thickness of mainspring 10 at the end of the first inner coil 11. Thus the second coil is superposed on the first coil with no overhanging or step which would be detrimental to the fatigue resistance of mainspring 10. This first variant concerns the case wherein step 60 is used as drawn, and acts then as a stop means for holding or hooking means 13 of mainspring 10.

In a second variant implementation of the invention, mainspring 10 is applied to arbor 1 so that the inner end 12 of the first coil is positioned in recess 64, mainspring 10 straddling the area around projecting point 62 so as to be wound onto arbor 1 on the side opposite recess 64 relative to step 60. This second variant concerns the case where step 60 is re-machined in the second touching-up or bar turning operation, to form a complementary stop or hooking means 3 for holding or hooking means 13 of mainspring 10. This touching-up is also necessary to enable mainspring 10 to pass over step 60 while guaranteeing the best possible support for mainspring 10 and limiting the shearing stresses to which it is subjected.

Preferably, in this second variant, in the second touching-up operation, a groove 44 is machined, of revolution about a touching-up axis DC parallel to the drawing direction, and having a width adjusted along the direction of said touching-up axis DC, for holding in position, in the direction of touching-up axis DC, the inner coil 11 of mainspring 10, on at least one point of the revolution thereof. This groove 44 is secant with step 60 between the surfaces thereof of smaller radius R1 and of larger radius R2 and preferably, groove 44 is substantially tangential to snail-shaped profile 30 in a tangency zone ZT substantially diametrically opposite step 60 relative to the touching-up axis DC of revolution of groove 44.

Thus, in the first drawing operation, a bar 50 is wire drawn to form at least one continuous profile 30, which is projecting or re-entrant relative to a support sector 2 having a circular or snail-shaped profile about an axis parallel to or merged with that of bar 50. The cross-section of this continuous profile 30 matches the projection, in a plane perpendicular to the drawing direction, of complementary hooking means 3 to be made on arbor 1, having a complementary profile to holding or hooking means 13 for a determined type of mainspring 10, which the corresponding arbor 1 is devised to hook. Manufacture by wire drawing gives the superficial surfaces better fatigue resistance, and provides better distribution of the stresses on projecting or re-entrant relief portions, in comparison to machining technologies using tools having a small radius, which create significant concentration of stress, especially in re-entrant angles, and which make the arbor fragile. Work hardening resulting from the wire drawing affects the entire peripheral surface and particularly the hooking zones, which thus maintain a high level of superficial hardness, and good resistance to wear.

A solid, constructed along generatrices parallel to the same curve, elevated on the basis of a flat closed profile will be called a "prism" here within the descriptive geometric sense. Preferably in the case of this description, the prism is a straight prism, whose generatrices are parallel to a touching-up axis DC and perpendicular to a particular profile, particularly a circular or snail shaped profile. In the case of the first variant, the profile, when selected to be snail-shaped, is then made according to the thickness of the first inner coil 11 of a mainspring 10 with which arbor 1 is intended to cooperate, and the increase in the snail over the periphery thereof is close to the thickness EI of said first coil 11, and calculated such that, when first coil 11 of the mainspring is wound onto arbor 1, it permanently bears, or at least as much as possible, on the support sector 2 formed by the lateral surface of the prism having a snail-shaped cross-section. Thus, when mainspring 10 covers the inner end 12 of the first inner coil 11, it is not deformed by any discontinuity of support between said support surface 2 and end 12.

In a second touching-up operation by re-machining or bar turning about a touching-up axis DC, the complete external contour of arbor 1 is machined or turned. Preferably, since this is most economical, the second touching-up operation is a bar turning or turning operation.

FIGS. 1A to 1H and 1J to 1N illustrate various non-limiting section profiles after wire drawing and which are well suited to making barrel arbors. Preferably, the continuous profile 30 is straight, i.e. delimited by generatrices parallel to the axis of bar 50. A twisted embodiment is possible, but involves higher costs, and the present description is limited to describing straight continuous profiles 30.

In a particular and preferred implementation of the invention, the production of an arbor 1 is linked to the anticipated use of this arbor 1 with a spiral strip mainspring 10 of determined type, or belonging to a family of springs having common features as regards the interface thereof with the barrel arbor. This interface especially concerns the first inner coil 11 which has a free inner end 12. This first coil 11 has a defined width LI and a defined thickness EI. This does not mean that inner end 12 cannot be made with a different profile, and/or a different width, and/or a different thickness, as will be seen in the following description.

Figure 7B:
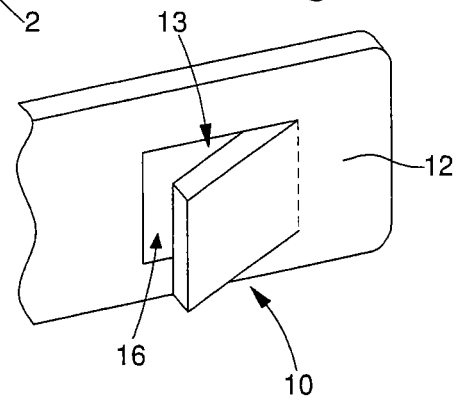
FIGS. 7A and 7B illustrate the stamping of the inner end of a mainspring, to define an aperture for hooking onto an arbor beak, or onto a pin in accordance with FIG. 6.
Figure 7A:
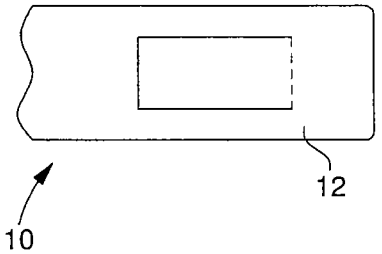

In an embodiment according to the second variant, depending upon the case, the inner free end 12 may or may not include an eyelet 16, which is for example stamped, or resulting from the folding of a three quarter stamped lug, as seen in FIGS. 7A and 7B. The free end 12 may also include a cut-out of particular shape, as will be explained below, and as seen for example in FIGS. 9C, 17A, 17B.

Figure 12:
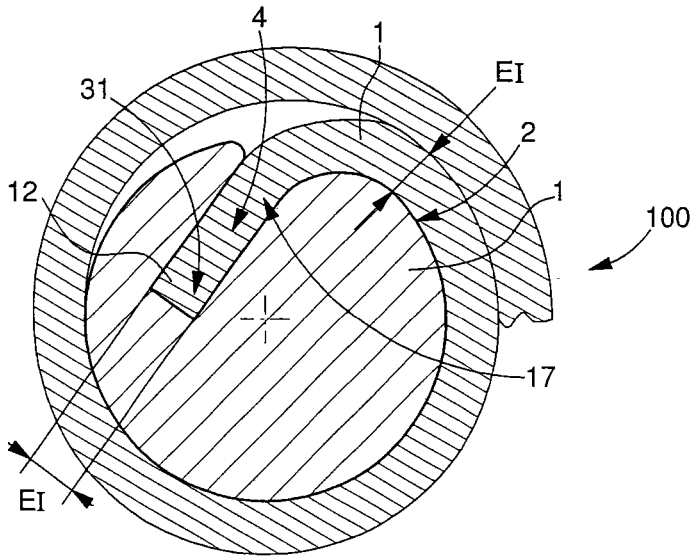
FIG. 12 shows, in a similar manner to FIG. 2, a variant wherein the arbor comprises a blind slot receiving the inner end of the mainspring.
Figure 13:
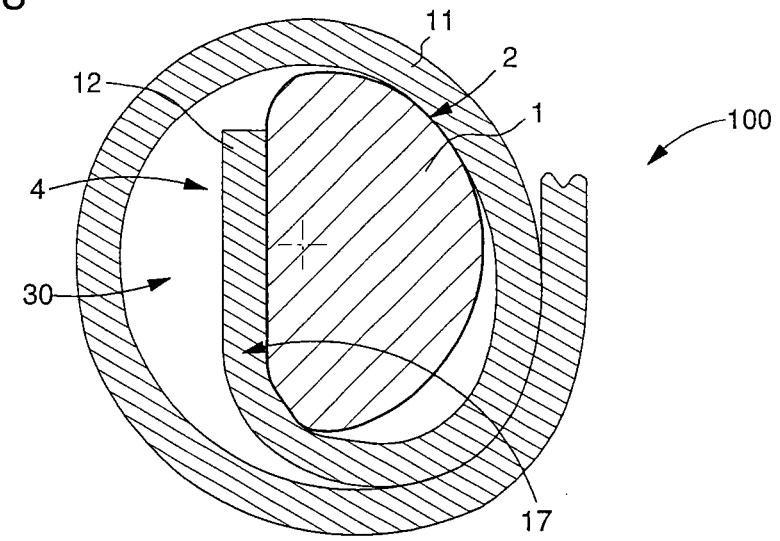
FIG. 13 shows, in a similar manner to FIG. 2, a variant wherein the arbor comprises a chamber delimited by a flat portion receiving the inner end of the mainspring.
Figure 14:
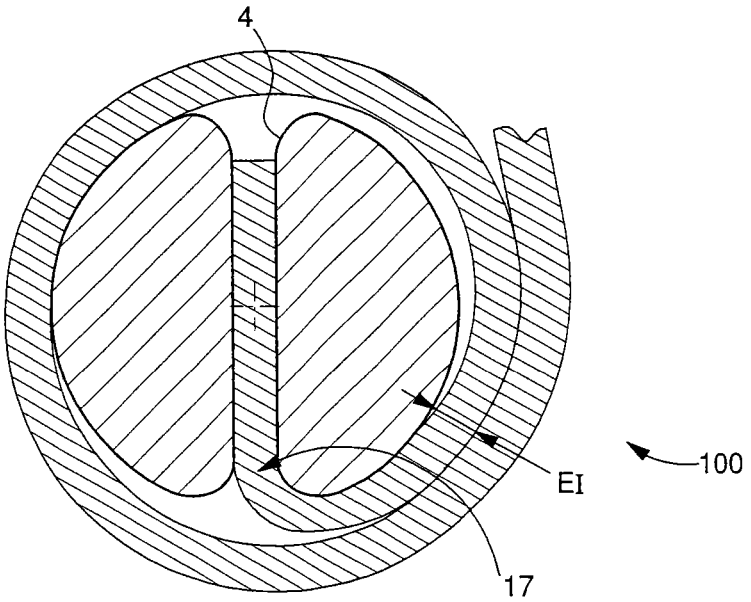
FIG. 14 shows a schematic cross-section perpendicular to the barrel axis of a mainspring wherein the end of the inner coil is folded at an angle close to 90°, and inserted into an arbor comprising a transverse slot, in a diameter, for housing said mainspring with no play.

In the case of FIG. 1C, a slot 31, having a width identical to the defined thickness EI of said first inner coil 11, is selected for the section of continuous profile 30. This embodiment is well suited to springs 10 comprising an end fold, forming a stop zone 17, as seen in particular in FIG. 12.

In the case of FIG. 1G, a groove 32 of width LG greater than defined width LI of first inner coil 11, is selected for the section of continuous profile 30. Where an arbor 1 made on this basis is combined with a mainspring 10 comprising a T-shaped end 12, as seen in FIG. 9C, the width LG is greater than or equal to and preferably equal to the length LT of a transverse bar of the T-shaped profile.

Figure 6:
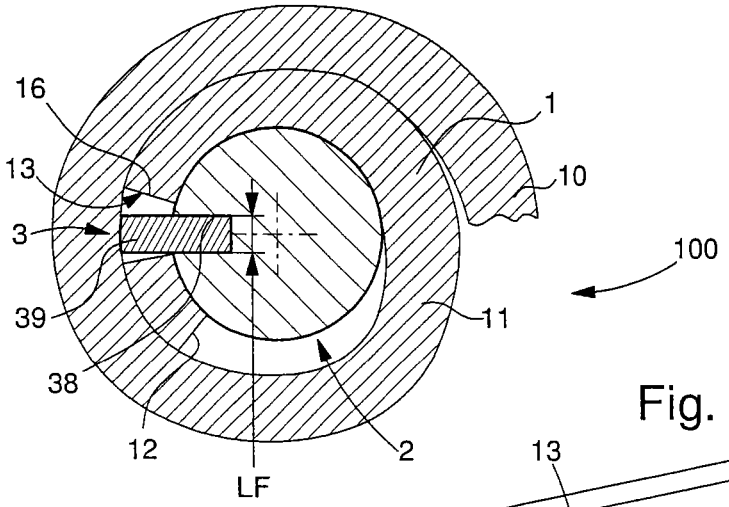
FIG. 6 shows a cross-section perpendicular to the barrel axis of a drive element with an arbor comprising a narrow longitudinal slot in FIG. 1H, or a pierced hole, in which a pin is inserted for holding the inner end of a mainspring, in an eyelet or a pierced hole or a hole comprised in the mainspring.

In the case of FIG. 1H, a narrow slot 38 having a width LF much smaller than defined width LI of first inner coil 11 is selected for the section of continuous profile 30. This narrow slot 38 is provided for the insertion of a pin 39 or a metal foil key, which form complementary hooking means 3 of arbor 1, which cooperates with an eyelet 16 of end 12 of first coil 11 of mainspring 10, as seen in FIG. 6. This narrow slot embodiment is an advantageous alternative to drilling a pin hole, which becomes a complex operation on an arbor of very small diameter, around several tens of millimeters, close to 1 millimeter.

In the case of FIGS. 1F, 1J, 1K, 1L, the section of continuous profile 30 is selected to be a tangential groove 33, along a generatrix of bar 50, whose profile matches that of a boss 15 comprised in first inner coil 11 of a corresponding mainspring, or whose profile is simply of sufficient size to form stop surfaces of a local raised portion of mainspring 10: a fold, winding, hook, lug, collar or similar.

Preferably, the profile of this groove 33 is an arc of a circle or similar, the centre of which is towards the exterior of the profile, and which is connected by two radii of concavity opposite its own to the circular or snail-shaped contour of the section of support sector 2. The section of boss 15 of the corresponding mainspring 10 is also in an arc of a circle, or similar, connected by two radii of concavity opposite to its own to the strand of the mainspring.

In the particular case of FIGS. 1J, 1K, 1L, the continuous profile 30 is that of a plurality of tangential grooves 33 each having a profile matching that of a boss 15, grooves 33 being angularly equidistant about a cylinder, or about a prism of snail-shaped section parallel to the pivot axis of arbor 1, comprising support sector 2 in the drawing direction. The embodiment of FIG. 1J is shown again in FIGS. 3A and 3B, for manufacturing an arbor 1 forming a drive element 100 according to FIG. 15B, the other component of which is the special mainspring 10 of FIG. 5A, which shows the end section 12 of this type of mainspring 10 which has been passed into a special calender to create bosses 15 in relief in distant waves, without any incipient cracks. Grooves 33, preferably having a rounded profile and with ends curved at a radius, form peripheral tangential grooves along generatrices, for receiving these bosses 15 and for retaining mainspring 10 perfectly, while ensuring good support contact between first coil 11 of mainspring 10 and the cylindrical sectors 2.

FIG. 1M illustrates the case of a relief portion with any type of hooking, having a continuous profile 30 which is both projecting and re-entrant, and the inscribing thereof, and a surface with cylindrical shoulders 2 within the envelope of bar 50.

Figure 16A:
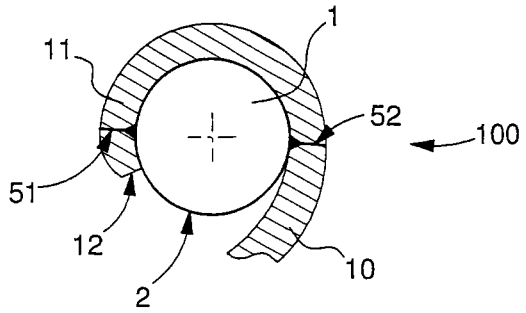
FIG. 16A illustrates an embodiment with a mainspring welded onto an arbor with two substantially diametrically opposite weld points.

FIG. 1N illustrates the case of a continuous profile 30 comprising two substantially diametrically opposite flat portions 36 and 37, which are preferably diametrically opposite relative to the drawing direction of a support sector 2. This embodiment is well suited to a variant illustrated in FIG. 16A, wherein the first inner coil 11 of mainspring 10 is welded at two diametrically opposite points, and preferably on flat portions 36 or 37 of this type.

FIGS. 2 to 4 illustrate advantageous embodiments on the basis of a wire drawn profile, which guarantee proper holding of the mainspring.

Figure 2A:
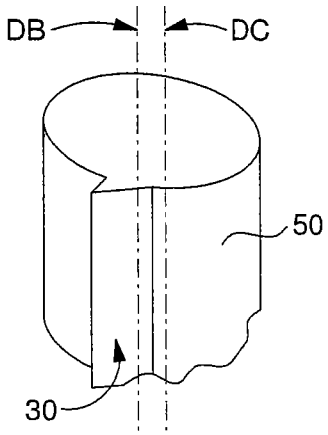
FIGS. 2A and 2B illustrate the making of a barrel arbor with a hook, by a first wire drawing operation according to FIG. 2A and a touching-up operation according to FIG. 2B.
Figure 2B:
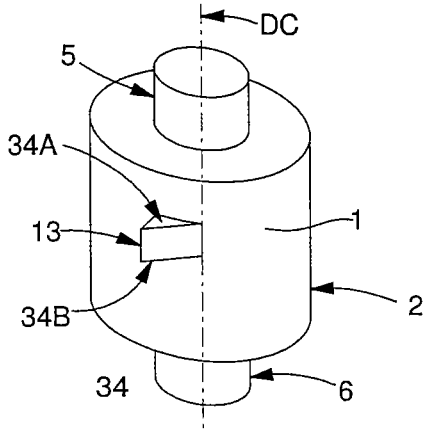

FIG. 2 illustrates the embodiment of a barrel arbor 1 with a hook 34, by a first wire drawing operation according to FIG. 2A, with a continuous profile 30 according to FIG. 1A, or 1B in a variant wherein the continuous profile 30 is that of a hook 34 joined to a housing 35 which provides better covering of first inner coil 11 by the next coil. The profile of hook 34 joined to said housing 35 matches that of an eyelet 16 comprised in an inner end 12 of the first inner coil 11 of a spiral strip mainspring 10 of determined type. During the touching-up operation according to FIG. 2B, particularly via bar turning, the top 34A and bottom 34B faces delimiting hook 34 are turned to cooperate with eyelet 16 and top and bottom shoulders 5 and 6 are rotated to pivotally guide arbor 1. This conventional configuration of a barrel arbor with a hook is thus achieved in a robust and economical manner, as a result of the wire drawing and immediate finishing by bar turning.

Figure 3A:
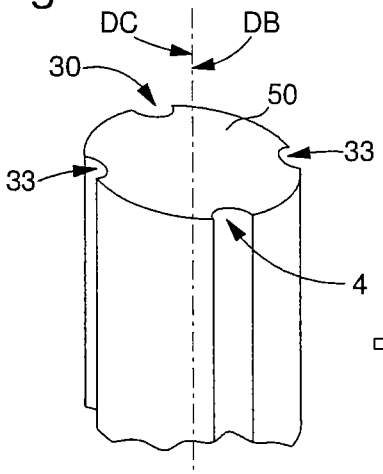
FIGS. 3A and 3B illustrate the making of a barrel arbor comprising tangential grooves parallel to the barrel arbor, by a first wire drawing operation in FIG. 3A and a touching-up operation in FIG. 3B.
Figure 3B:
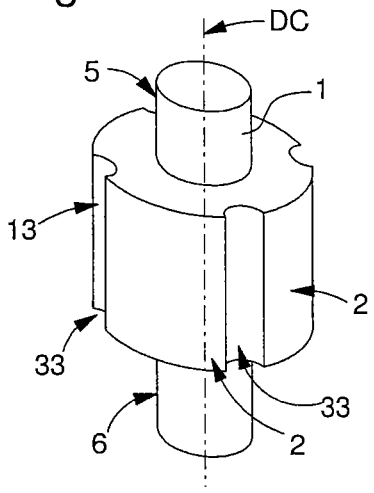
Figure 5B:
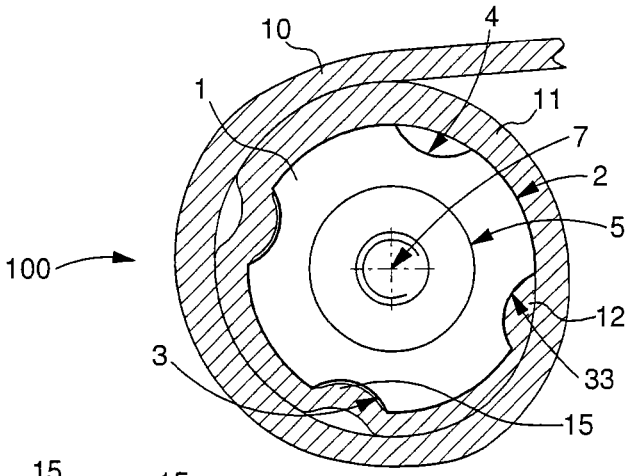
FIG. 5B shows a top view along the barrel axis of a drive element with a corresponding arbor, as shown in FIG. 1J, which includes tangential peripheral grooves along generatrices, for receiving said bosses and holding the mainspring.
Figure 5A:
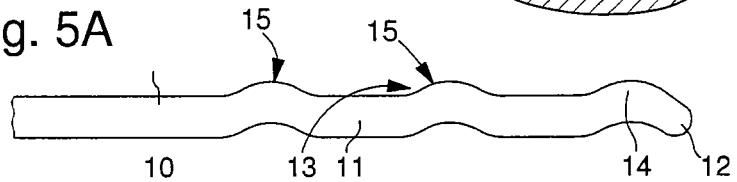
FIG. 5A illustrates the end section of a mainspring which has been passed through a special calender to create bosses in relief in distant waves, without incipient fractures.

FIG. 3 illustrates the embodiment of a barrel arbor 1 comprising tangential grooves 33 parallel to the barrel arbor, by a first wire drawing operation according to FIG. 3A, with a continuous profile 30 as illustrated, for example, in FIGS. 1F, 1J, 1K, 1L and a touching-up operation according to FIG. 3B, also preferably via bar turning for finishing arbor 1 and the top 5 and bottom 6 shoulders thereof. As explained above and seen in FIGS. 5A and 5B, this arbor 1, in conjunction with a mainspring 10 arranged in a particular manner and with no incipient cracks as a result of an undulated profile having no folding zones or zones of very small radius, provides a very good peripheral hold of mainspring 10 over the entire area of the first coil 11. FIGS. 5C and 5D illustrate an advantageous variant of mainspring 10, which is stamped to create, between parallel slots along the elongation of the mainspring, at least one median folded lug forming a boss 15 projecting relative to the rest of the surface of mainspring 10. This configuration has the advantage of correcting the shake of the mainspring. This configuration can be used, not only in the particular case where it is advantageous for at least one boss 15 to cooperate with grooves 33 of an arbor 1, but also in the general case where it is desired to precisely position, in the direction of the barrel axis (or a balance axis or any axis intended to receive a timepiece mainspring), a spiral mainspring of this type, and in particular, in the case of a barrel, relative to the drum and to any cover.

Figure 4A:
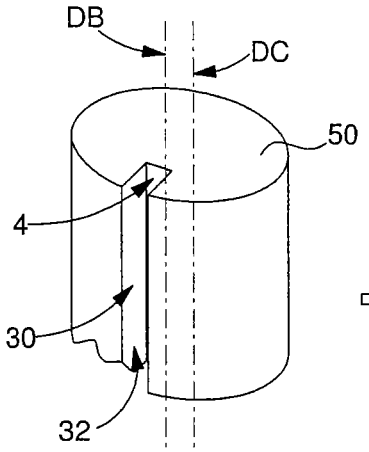
FIGS. 4A and 4B illustrate the making of a barrel arbor comprising a tangential groove parallel to the barrel arbor, intersecting a circular groove centred on a touching-up axis parallel to the direction of the arbor, by a first wire drawing operation in FIG. 4A and a touching-up operation in FIG. 4B.
Figure 4B:
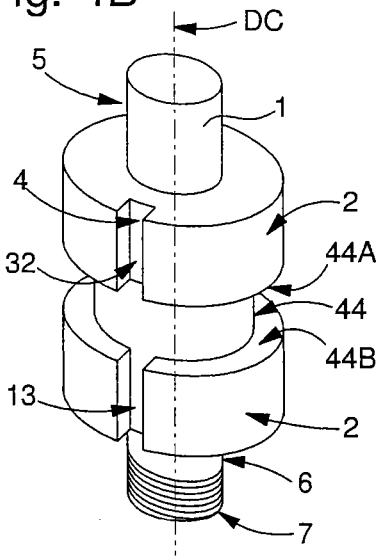

FIG. 4 illustrates the embodiment of a barrel arbor 1 comprising a tangential groove 32 parallel to barrel arbor DB, intersecting a circular groove 44 centred on a touching-up axis parallel to the axis of the arbor and thus off-centre relative to the barrel axis, by a first wire drawing operation during which tangential groove 32 is made, according to FIG. 4A, with a continuous profile 30 according to FIG. 1G, and a touching-up operation according to FIG. 4B, during which circular groove 43 and the top 44A and bottom 44B delimiting surfaces, and the top 5 and bottom 6 shoulders of arbor 1 are made.

Preferably, as explained above, tangential groove 32 has a width LG greater than the defined width LI of the first inner coil 11. FIGS. 9C and 9D show a preferred variant of the associated mainspring 10, comprising a T-shaped end 12, with a head 18 of length LT connected to the rest of mainspring 10 by a core 19, preferably adjacent to chamfers 19A for improved winding support for the mainspring. Width LG is greater than or equal to and preferably equal to this length LT of a transverse bar. Preferably, the width LL of circular groove 44 is equal to the width of core 19, and the bottom of groove 44 defines a cylindrical support surface 2A for supporting said core 19, the support sector 2 serving as support for the total width LI of the mainspring section, which follows core 19, opposite head 18.

Figure 17A:
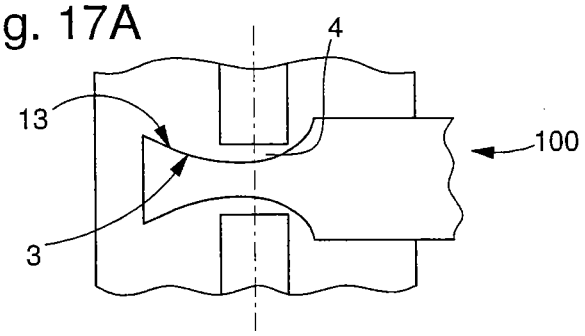
FIG. 17A illustrates a particular embodiment wherein the inner end of the mainspring is dovetailed, to cooperate with an opposing profile arranged on the arbor, comprising two shoulders here.
Figure 17B:
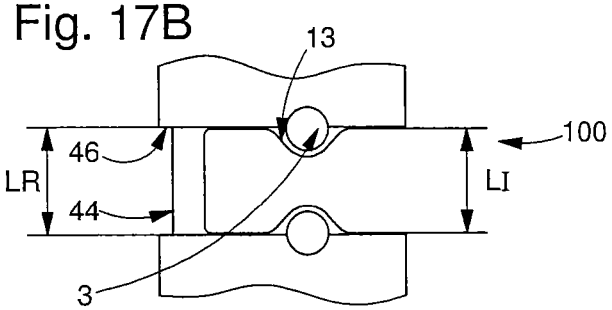
FIG. 17B illustrates a similar variant with a mainspring end comprising two recesses, cooperating as a stop member with two pins plugged into the corresponding arbor.
Figure 18:
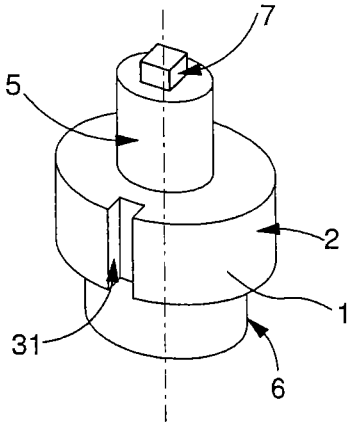
FIG. 18 illustrates, in perspective, an arbor with a drawn tangential groove, and a ratchet driving means in the shape of a square.

This T-shaped profile is a non-limiting economical example. FIG. 17A illustrates a particular embodiment of the dovetailed inner end of the mainspring, for cooperating with an opposing profile arranged on the arbor, here comprising two shoulders. FIG. 17B illustrates a similar variant with a mainspring end 12 comprising two recesses, cooperating as a stop with two pins fitted into the corresponding arbor 1. Preferably, end 12 of mainspring 10 is embedded in a circular groove 44, abutting on a flank 46 of the groove on at least one side, and preferably on both sides.

Figure 19:
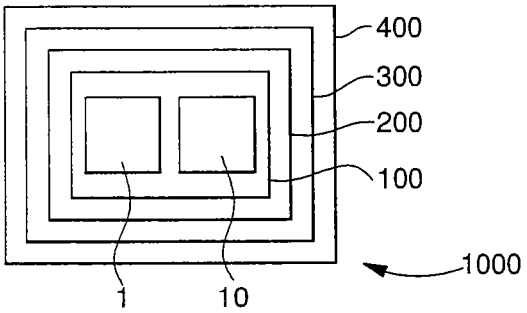
FIG. 19 is a block diagram of a timepiece, comprising a movement which includes a barrel, in turn including a drive element comprising an arbor and a mainspring according to the invention.

The method of producing an arbor 1 advantageously comprises an operation of machining a ratchet driving means 7 by internal or external threading, or turning, or milling facets, as seen in FIG. 19, where said drive means 7 is formed by a conventional square. Preferably, to avoid touching-up, this drive means 7 consists of an internal or external thread achievable by turning during the second touching-up operation of arbor 1 after wire drawing, as seen in FIG. 4A (internal thread) or in FIG. 5B (external thread).

Figure 8A:
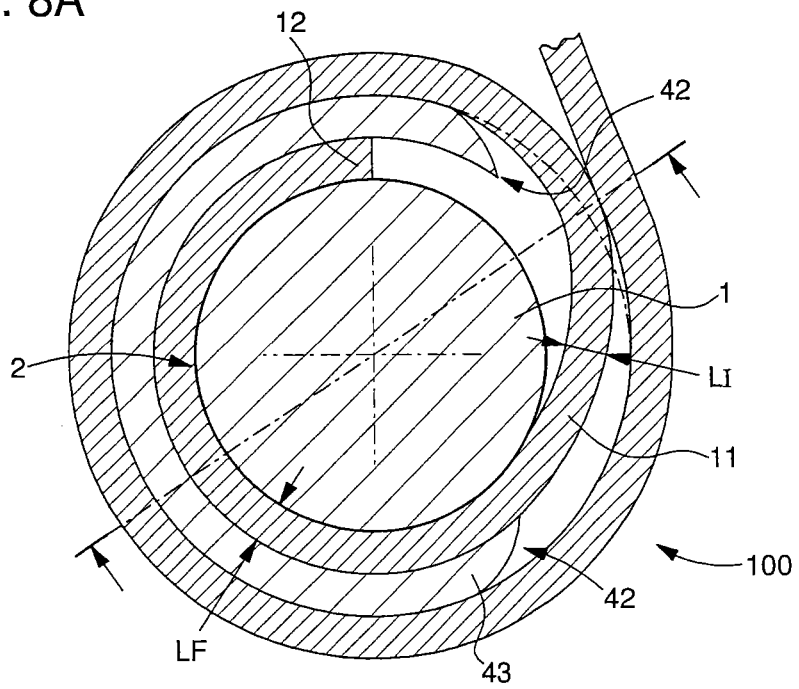
FIG. 8*a* shows, in a similar manner to FIG. 2, a variant wherein the arbor has a frontal groove opening through an aperture and receiving the inner end of the mainspring.
Figure 8B:
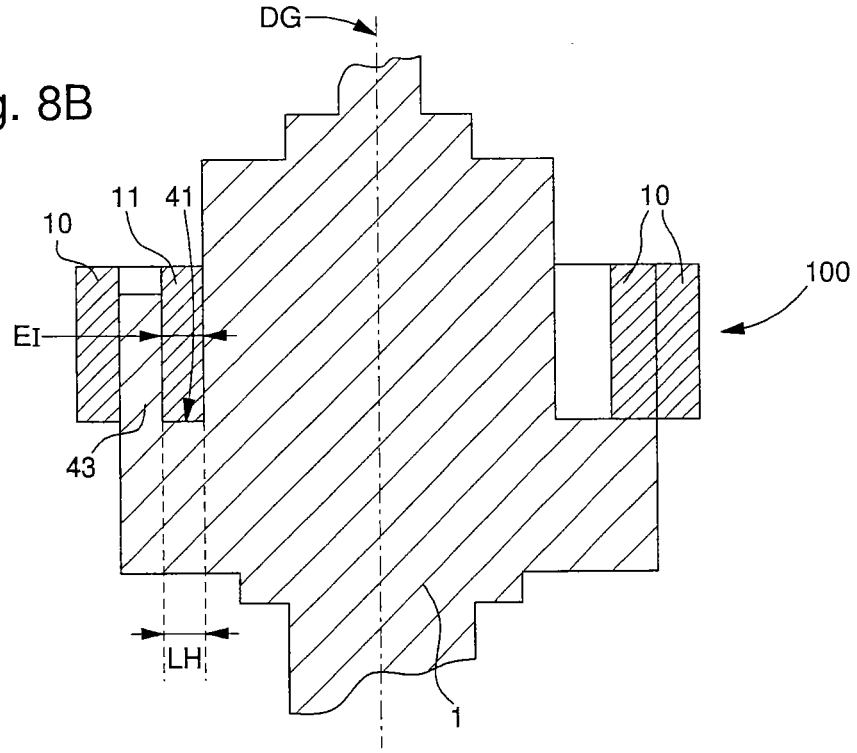
FIG. 8B is a cross-section of the same assembly in a plane passing through the arbor axis.

FIGS. 8A and 8B show an arbor 1 comprising a frontal groove 41 opening through an aperture 42 and receiving the inner end 12 of mainspring 11, made by a method which includes an operation of machining a frontal groove 41 of revolution about an axis DG parallel to or merged with pivot axis D, frontal groove 41 having a width LH equal to a defined width LI of the first inner coil 11 of a spiral strip mainspring 10 of determined type. This machining operation further includes the machining of at least one aperture 42 in an external wall 43 of frontal groove 41, aperture 42 having a width larger than a defined thickness EI of the first inner coil 11 of a spiral strip mainspring 10 of determined type, to allow said first inner coil 11 to pass therein.

Preferably, during manufacture of an arbor 1 according to any of the methods described above, a superficial roughness of more than 12 Ra micrometers, is given to at least one portion of support sector 2 in the wire drawing direction, in the form of a flute made during the first wire drawing operation, or a knurling made during the second touching-up operation. This roughness allows a friction hold between the arbor and the mainspring, especially if the mainspring has a similar friction surface on first inner coil 11, on the face thereof facing the axis of arbor 1. Naturally, this type of friction surface may, as an alternative to this mechanical embodiment, result from a surface treatment, an electroplated type projection or similar.

The invention concerns a drive element 100 for a timepiece barrel, comprising at least a spiral strip mainspring 10 of determined type comprising a first inner coil 11 having a defined width LI and thickness EI and the first inner coil 11 comprising, for the holding thereof on a barrel arbor 1, at an inner end 12, a holding or hooking means 13 having a determined profile 14. This drive element 10 further includes a barrel arbor 1 preferably formed by wire drawing a bar 50 and made via one of the methods described above.

This arbor 1 includes a means 5, 6 of pivotal guiding about a pivot axis DP, and includes at least one support sector 2 for supporting a first inner coil 11 of at least one mainspring 10, arbor 1 including a complementary hooking means 3 having a profile 314 complementary to profile 14 of the holding and hooking means 13 for the pivotal cooperation thereof with said at least one mainspring 10.

According to whether the holding or hooking means 13 of mainspring 10 is in projecting or recessed relief, the complementary hooking means 13 of arbor 1 is in respectively recessed or raised relief.

In the embodiments of FIG. 8A, 8B, 12, 13 or 14, of drive element 100, set back internally relative to a cylinder or relative to a prism of snail-shaped section and parallel to the pivot axis of arbor 1, comprising support sector 2, arbor 1 includes at least one cavity 4 for receiving holding or hooking means 13 and/or at least one portion of the first inner coil 11.

In the particular case of FIGS. 8A and 8B, this cavity 4 includes a frontal groove 41, the width LH of which is arranged to receive mainspring 10 with minimum play. In an advantageous embodiment, frontal groove 41 is of revolution about an axis DG parallel to or merged with pivot axis D, and the width LH thereof is equal to the defined width LI of the first inner coil 11 of a said mainspring 10. arbor 1 includes at least one aperture 42 in an external wall 43 of frontal groove 41, said aperture 42 having a width larger than the defined thickness EI of first inner coil 11, to allow said first inner coil 11 to pass therein. Preferably, this aperture 12 is wide enough to allow first coil 11 to be held without excessive stress, yet small enough to ensure proper retention of end 12 of mainspring 10. Preferably, the angle at the centre in which said aperture is inscribed is comprised between 120° and 180°.

In the particularly advantageous embodiment of drive element 100 according to FIG. 5B, set back internally relative to a cylinder, or to a prism of snail-shaped section parallel to the pivot axis of arbor 1, comprising support sector 2, arbor 1 includes at least one cavity 4 for receiving holding or hooking means 13 and/or at least one portion of the first inner coil 11, and the at least one cavity 4 includes a plurality of tangential grooves 33 parallel to pivot axis D and each having a profile matching that of a boss 15 comprised in the first inner coil 11 of a spiral strip mainspring 10 of determined type, the grooves 33 being preferably angularly equidistant about a cylinder, or about a prism of snail-shaped section parallel to the pivot axis of arbor 1, comprising a support sector 2 in the wire drawing direction. This equidistance is not essential, but it has the advantage of enabling mainspring 10 to be presented in abutment, via the boss 15 thereof the closest to free end 12, in any one of grooves 33, the other bosses 15 then naturally being in phase with the other grooves 33. Mainspring 10 then includes a series of bosses 15 having a lower or equal number to that of grooves 33, separated by the same curvilinear pitch as grooves 33, and arranged to fit into grooves 33.

In a particular embodiment of drive element, set back internally relative to a cylinder or relative to a prism of snail-shaped section and parallel to the pivot axis of arbor 1, comprising support sector 2, arbor 1 includes at least one cavity 4 for receiving holding or hooking means 13 and/or at least one portion of the first inner coil 11. The wire drawing direction of support sector 2 is parallel to or merged with pivot axis D, and at least one cavity 4 is sized to receive the inner end 12 or at least one portion of first inner coil 11 with no play, in the direction of width LI of mainspring 10.

Figure 16B:
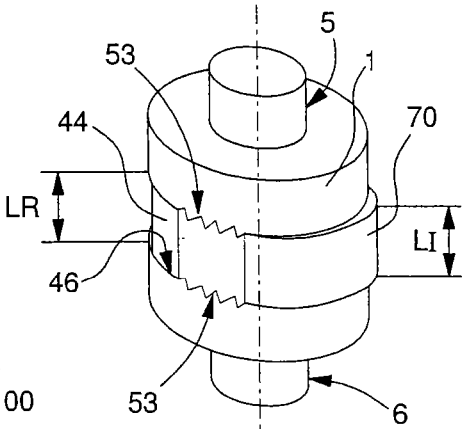
FIG. 16B illustrates a mainspring mounted and fitted into a groove of an arbor, then hammered into position in order to be retained.

In the drive element of FIGS. 4A, 9A, 16B, of drive element 100, set back internally relative to a cylinder or relative to a prism of snail-shaped section and parallel to the pivot axis of arbor 1, comprising support sector 2, arbor 1 includes at least one cavity 4 for receiving holding or hooking means 13 and/or at least one portion of the first inner coil 11 and cavity 4 includes a groove 44 of revolution about the drawing direction of support sector 2 and having a width LR equal to the width LI of the first inner coil 11 of mainspring 10.

In the embodiment of FIG. 6, set back internally relative to a cylinder or relative to a prism of snail-shaped section and parallel to the pivot axis of arbor 1, comprising support sector 2, arbor 1 includes a narrow slot 38 having a width LF much smaller than the defined width LI of the first internal coil 11, and into which a pin 39 or a metal foil key forming complementary hooking means 3 is inserted.

In the variants of FIGS. 10B, 11B, 12, 13, 14, inner end 12 of first inner coil 11 of mainspring 10 is folded or rolled towards the wire drawing direction of support sector 2, so as to form a drive stop 17. FIGS. 10A and 10B illustrate an arbor 1 comprising a cavity 4 formed by a recess curved in a half moon. The corresponding mainspring 10 has an inner end 12 wound on a small radius and housed in said recess 4. FIGS. 11*a* and 11B illustrate an arbor 1 comprising, substantially parallel to each other, a flat portion 47 and a slot 48 for housing the inner coil 11 of mainspring 10: the inner end 12 thereof abuts on flat portion 47 and coil 11 is slid into slot 48.

Figure 15:
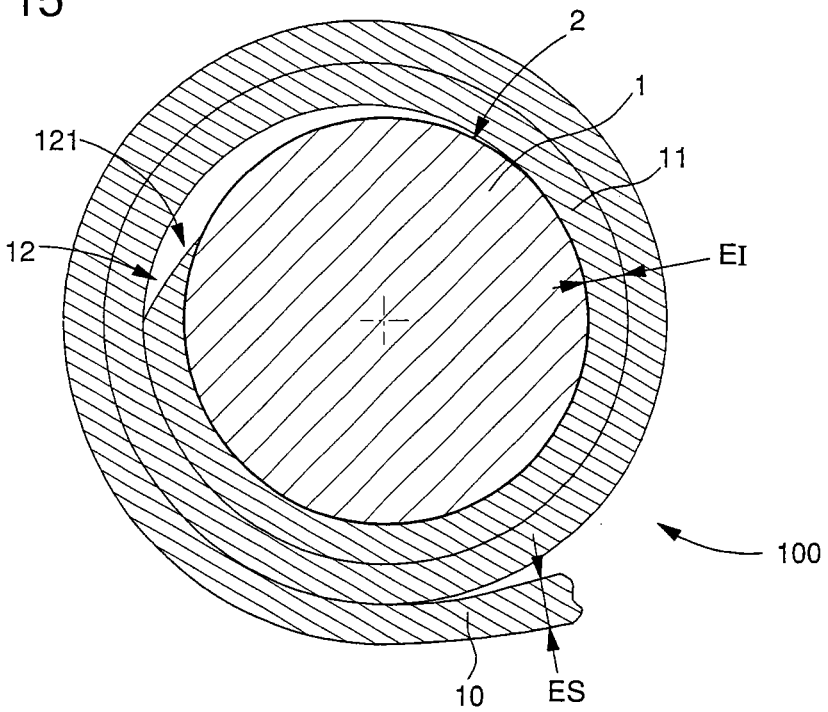
FIG. 15 shows a schematic cross-section perpendicular to the barrel arbor of a mainspring whose inner coils are thinned relative to the other coils, partially wound onto a cylindrical arbor.

In an advantageous embodiment illustrated in FIG. 15, the defined thickness EI of first inner coil 11 of mainspring 10 is smaller than the thickness ES of the following coils of mainspring 10. Said following coils either have a constant section relative to each other or a tapered section moving away from first inner coil 11.

This embodiment is applicable to all the barrel arbor variants described here and enables the first inner coil 11 to be pressed onto arbor 1 in an optimum manner, and in particular onto the cylinder sector(s) comprised therein. Advantageously, the free end 12 includes a chamfer 121 or a curved portion, so as to allow the next coil to be wound properly.

In a particular embodiment, at least one inner end 12 of first inner coil 11 of mainspring 10 has, on the inner face thereof intended to abut on support sector 2 of arbor 1, a roughness of more than 12 Ra micrometers.

The relative hold between mainspring 10 and arbor 1 may be achieved by removable complementary means, such as a hook and eye or similar. In an alternative, the hold may be achieved by a permanent connection between the mainspring and arbor, by an irreversible securing method, by welding, brazing, bonding or similar. In a particular version illustrated in FIG. 16A of a drive element 100, at least one mainspring 10 is welded onto arbor 1 at two substantially diametrically opposite points 51, 52 relative to the direction of wire drawing of support sector 2. In a variant wherein arbor 1 has a profile according to FIG. 1N, these points 51 and 52 are applied to flat portions 36 and 37 of arbor 1, substantially diametrically opposite to the wire drawing direction of support sector 2.

The production methods proposed for arbors 1 specifically devised for springs 10 of determined type enable opposing elements to be sized to allow the assembly of one on the other with no play. In particular, at least one mainspring 10 is held with no play in an annular groove 44 of arbor 1 around support sector 2, or in a straight groove 45 of arbor 1 along a generatrix of arbor 1.

Advantageously, when irreversible retention is desired, inner end 12, or at least one portion of first coil 11, is retained irreversibly in groove 44, 45 by welding or brazing, or, in a very economical manner, by hammering or local crushing in deformation zones 53, on mainspring 10 and/or arbor 1. FIGS. 16B and 16C illustrate a mainspring 10 fitted and mounted to project into a circular groove 44 of an arbor 1, and hammered into position to be retained, particularly by the action of a knurl or similar, so as to create deformation surfaces 53 which immobilise the mainspring relative to the arbor. FIG. 16D illustrates in a similar manner, which is preferred in the usual case where the hardness of the mainspring is greater than that of the arbor, an application where the knurl is applied to the walls of a groove in which the mainspring is clamped to confine the latter underneath deformation zones 53.

FIGS. 20 to 26 illustrate particular embodiments of the second variant.

Figure 20:
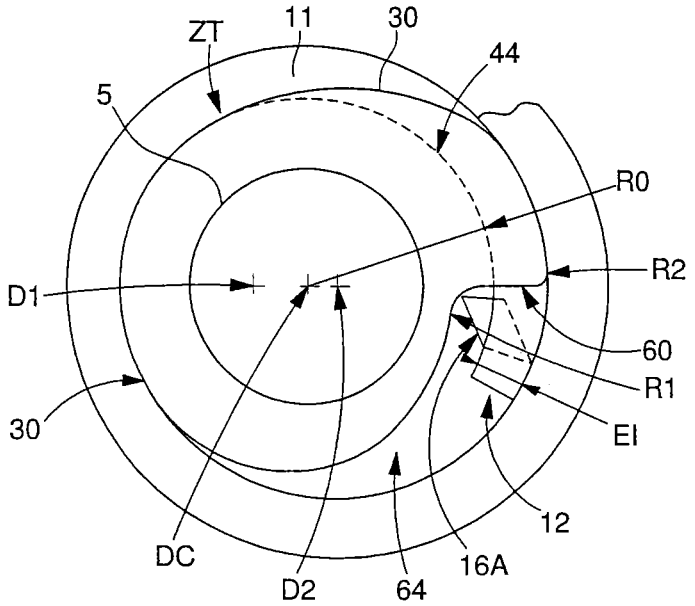
FIG. 20 shows a schematic, end view of a barrel drive element with a progressive profile in the shape of a snail, carrying a mainspring.
Figure 21:
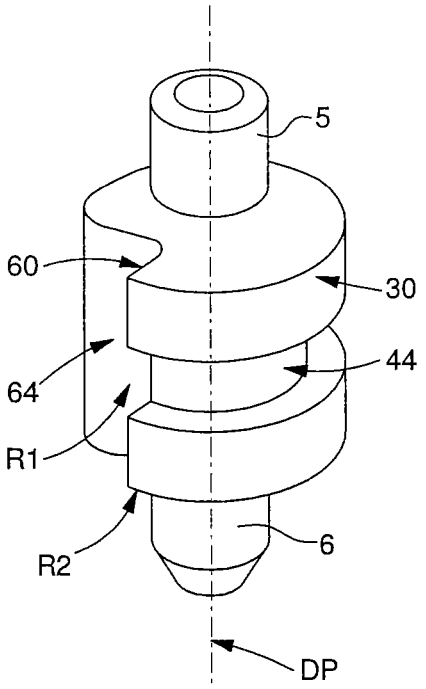
FIG. 21 shows a perspective view of the drive element of FIG. 20.
Figure 22:
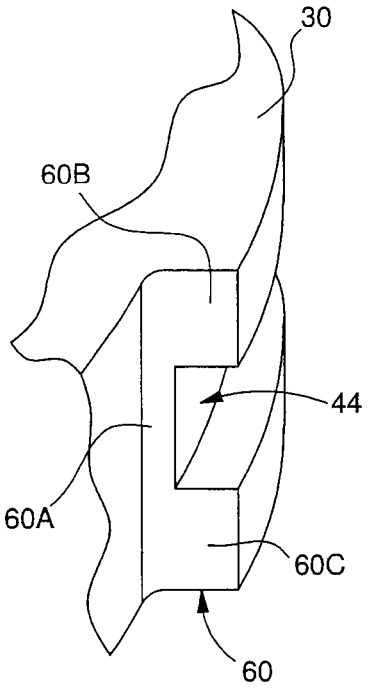
FIG. 22 shows a perspective view of a detail of the arbor showing, seen from a recess receiving the inner end of the coil, an arbor support surface which is intended to cooperate with a mainspring stopping surface, said support surface being extended on both sides by a peripheral groove arranged for receiving the mainspring, over a tapered part of the thickness thereof throughout the winding of the mainspring.

FIG. 20 shows a drive element 100 for a barrel with an arbor 1 having a tapered snail-shaped profile 30 carrying a mainspring 10. FIGS. 21 and 22 show the configuration pertaining to this variant, with a support surface 3 formed by the zone of intersection between support face 60 and peripheral groove 14, which defines, on both sides thereof and of a median zone 60A, two particularly robust supports 60B and 60C working in compression, forming stop means for absorbing the stress caused by winding mainspring 10.

Peripheral groove 44 is arranged to receive mainspring 10 over a decreasing portion of the thickness thereof throughout the winding of the mainspring: from total thickness EI of the mainspring which may be fitted onto support face 60, or at least a significant fraction of said total thickness, for good axial retention of the mainspring, up to a tangency zone ZT where groove 44 is tangent with a peripheral support surface 2, and where mainspring 10 is completely free axially.

Figure 23:
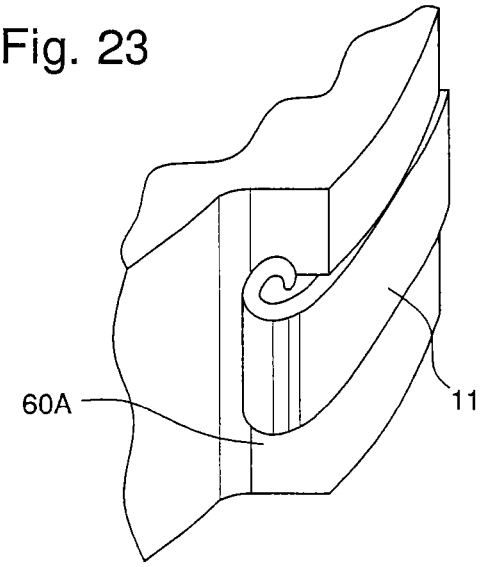
FIGS. 23 to 26 illustrate, in a similar manner to FIG. 22, this same zone of the arbor fitted with a mainspring, whose stop surface takes various forms: a winding or fold in FIG. 23, a T-shaped cut-out in FIG. 24, a dovetailed cut-out in FIG. 25, a stamped eyelet forming a tongue in FIG. 26, shown in an end view in FIG. 26A.
Figure 24:
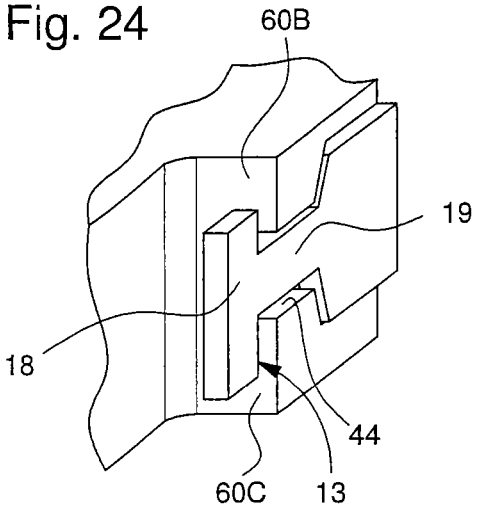
Figure 25:
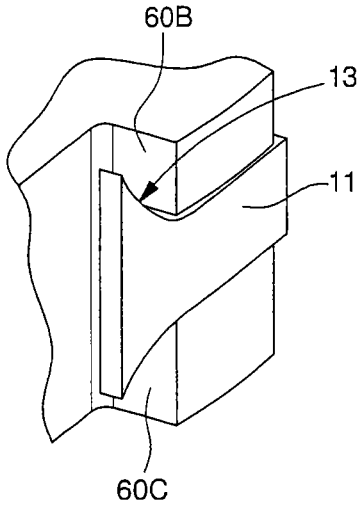
Figure 26:
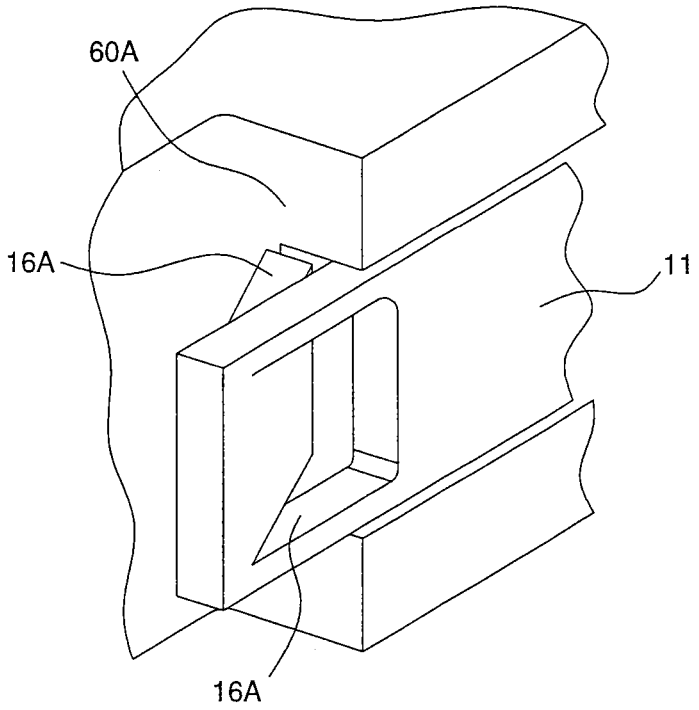
Figure 26A:
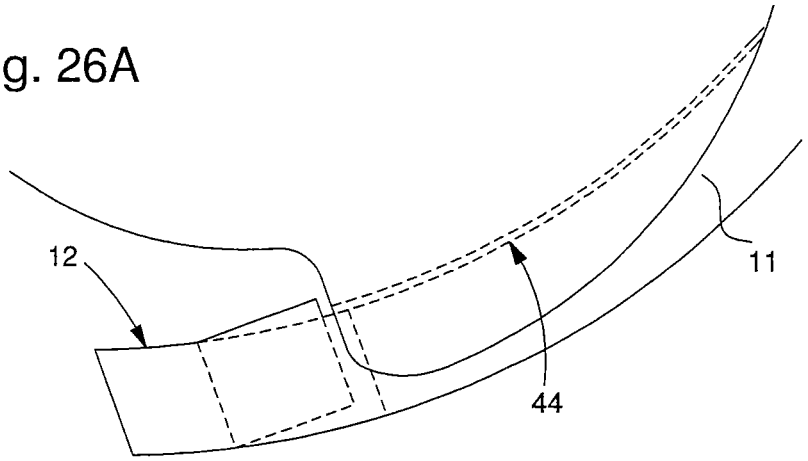

In FIGS. 23 to 26, the stop surface 13 of mainspring 10 takes various forms: a winding or fold in FIG. 23, a T-shaped cut-out in FIG. 24, a dovetailed cut-out in FIG. 25, a stamped eyelet forming a tongue in FIG. 20 or FIG. 26, the latter shown in an end view in FIG. 26A.

FIGS. 27 to 30 illustrate a profile embodiment well suited to an arbor 1 of small dimensions. With the exception of a hook 34 which cooperates with an eyelet 16 of mainspring 10, this arbor 1 has a snail-shaped profile 30.

The radius R0 which serves as a support for the end 12 of inner coil 11 of mainspring 10 has a very small diameter here, with a value of 0.26 mm, whereas the largest radius R2, which is equal to the maximum radial space requirement of hook 34, and to the support of the second coil of the mainspring, has a value of 0.42 mm. The radial space devoted to the mainspring is therefore equal to a thickness of close to 0.08 mm. The K factor, which is the ratio between the core radius, here the radius R0 of arbor 1, and the thickness of mainspring 10, is close to 1.6, which is a particularly low value since it is estimated, for usual horological mainspring (Nivaflex® or similar) and arbor (steel or stainless steel) quality, that this ratio must be higher than 10 to avoid breaking the arbor.

The minimum core radius R0 depends especially on:

the Hertz pressure on the pivoting of arbor 1 with the bridge and the bottom plate, or with the cover and drum of the barrel, according to the type of assembly of arbor 1. This depends on the mainspring torque, the pivot diameters and the height thereof and the materials in contact;

the twisting and bending stresses to which arbor 1 is subjected. This is also dependent on the mainspring torque and the geometry of the arbor;

the shearing stresses to which hook 34 of arbor 1 is subjected when mainspring 10 is wound about the core. This depends on the mainspring torque but also on the geometry of the hook, which in turn depends on the maximum aperture of eyelet 16, which may be made in mainspring 1, through which the hook drives mainspring 1 on the core;

on the space available between the core of arbor 1 and the second coil of mainspring 10 wound on the core in order to ensure that the inner end 12 of mainspring 10 at the centre does not disrupt the winding thereof. This depends above all on the thickness of mainspring 10.

As seen in a particular variant illustrated in FIGS. 28 and 29, the peripheral profile 70 of arbor 1 is broken down as follows:

in the area of hook 34 (section BB of FIG. 30):

a first cylindrical sector 71, having a minimum radius R0, centred on axis DC, between marks A and B, a rapidly increasing junction zone 72 between marks B and C, which is flat and forms an angle α with a radial plane, said angle α being comprised between 0° and 45°, a second cylindrical sector 73, between marks C, D and E, centred on an axis D2 which is off-centre relative to axis DC, said eccentricity being comprised between R0/4 and R0/3;

a junction zone 74, tangent to second sector 73, between marks E and F, said junction zone is advantageously substantially flat; said junction zone 74 defines, in the portion thereof with the largest radial extension, the back of hook 34;

a third cylindrical sector 75, between marks F and G, centred on axis DC, forming the edge of hook 34 and the support zone for the second coil of mainspring 10 when it is superposed on the first coil 11;

a support face 76, between marks G and A, forming the active surface of hook 34 for cooperating in abutment with a stop surface 16A of mainspring 10, formed here by one of the faces of an eyelet 16; preferably, this support face 76 is flat, and undercut relative to a radial plane originating from axis DC, so as to ensure support for mainspring 10, regardless of the thickness of said mainspring 10, on support face 76;

in the zone outside hook 34 (section CC of FIG. 30);

a first cylindrical sector 71, between marks H and B, having a minimum radius R0, centred on axis DC; mark H is such that the curvilinear abscissa HA is smaller than the length of the aperture of eyelet 16 of mainspring 10;

a rapidly increasing junction zone 72 between marks B and C, which is flat and forms an angle α with a radial plane, said angle α being comprised between 0° and 45°, a second cylindrical sector 73, between marks C, D, E and H, centred on an axis D2 which is off-centre relative to axis DC, said eccentricity being comprised between R0/4 and R0/3, and said second sector 73 being substantially tangent with the first sector 71 at H.

The variant of FIG. 30 shows a first zone which is broken down, on the one hand, into a flat portion 71A, between marks A and A', and forming a right or obtuse angle at A with the flat support face 76, so as to allow combined milling of surfaces 76 and 71A, and on the other hand, the first cylindrical sector 71 extending between marks A' and B, having a minimum radius R0, centred on axis DC and whose tangent at B forms a right or obtuse angle with junction zone 72.

The variant of FIG. 31 shows a first zone which is broken down, on the one hand, into a flat portion 71A, between marks A and A', and perpendicular at A to the flat support face 76, so as to allow combined milling of surfaces 76 and 71A, and on the other hand, a second flat portion 71B extending between marks A' and B, and forming a right or obtuse angle at B with the flat junction zone 72, so as to allow combined milling of surfaces 71B and 72.

In the case of FIGS. 31 and 32, the distance to axis DC from surfaces 71A and 71B is preferably comprised between the values 0.8 R0 and R0.

All of the configurations set out above are suitable for stopping mainspring 10 on arbor 1 by a weld spot, laser weld (radial or parallel to the axis), brazing, bonding or similar.

The invention also concerns a timepiece movement 1000 including at least one drive element 100 of this type. This mechanism 1000 is a barrel 200, or a movement 300 incorporating at least one barrel 200, or a timepiece 400 incorporating at least one movement 300, incorporating at least one barrel 200.

What is claimed is:

1. A method of producing a drive element for a timepiece barrel, comprising at least one spiral strip mainspring of determined type comprising a first inner coil with a defined first width and first thickness, said first inner coil comprising, for the holding thereof on a barrel arbor, at an inner end, a holding or hooking means having a defined profile, said drive element further comprising a barrel arbor, the method comprising:

drawing, in a first wire drawing operation, a bar so as to form, about an axis parallel to a direction of the drawing, a progressive profile in a shape of a snail between a smaller radius and a larger radius, with a step between points on said larger radius and said smaller radius, said profile in the shape of a snail comprising a support sector for said inner coil; and machining or turning, in a second touching-up or bar turning operation of said drawn bar about a touching-up axis parallel to or merged with the direction of the drawing, a complete external contour of said arbor, the complete external contour comprising at least one cylindrical shoulder for pivotally guiding said arbor, wherein said step is used, either as a stop means for said means of holding or hooking said mainspring when said step is used as drawn, or as a complementary stop or hooking means for said holding or hooking means for said mainspring when said step is re-machined during said second touching-up or bar turning operation, and wherein, in said second touching-up operation, a peripheral groove is machined, of a revolution about the touching-up axis parallel to the direction of the drawing, and a width of the groove is adjusted along the direction of said touching-up axis, to hold in position said inner coil of said mainspring in the direction of said touching-up axis, on at least one point on the revolution thereof, said groove being secant with said step, between the surfaces thereof of smallest radius and of largest radius, and said groove being substantially tangent to said profile in the shape of a snail in a zone substantially diametrically opposite to said step relative to said touching-up axis of revolution of said groove.

2. The method of manufacturing a drive element for a timepiece barrel according to claim 1, wherein said step is made with a difference between said smallest radius and said largest radius, which is greater than or equal to said first thickness of said first inner coil of said mainspring.

3. The method of manufacturing a drive element for a timepiece barrel according to claim 2, wherein said means of holding or hooking said mainspring is made with a T-shaped profile at the inner end of said first inner coil, comprising a transverse bar attached by a core of reduced width to the first inner coil having said first width of said mainspring, and wherein the width of said groove is selected to be a width greater than or equal to that of said reduced width of said core.

4. The method of manufacturing a drive element for a timepiece barrel according to claim 2, wherein said means of holding or hooking said mainspring is made with a dovetailed profile wherein a width of a widest portion is greater than the width of said groove, and wherein a narrowest portion is arranged to be immobilized in abutment on said step at an entry to said groove.

5. The method of manufacturing a drive element for a timepiece barrel according to claim 2, wherein, after said groove has been machined, said holding or hooking means of said mainspring is placed in abutment on said step or on said complementary stop or hooking means machined from said step, wherein said mainspring is immobilized in an irreversible manner in said groove by welding, and/or brazing, and/or hammering said arbor and/or said mainspring.

6. The method of manufacturing a drive element for a timepiece barrel according to claim 1, wherein said holding or hooking means for said mainspring is made with at least one boss on said first inner coil, achieved by permanent local deformation of said mainspring.

7. The method of manufacturing a drive element for a timepiece barrel according to claim 1, wherein said holding or hooking means for said mainspring is made with at least one lug on said first inner coil made by stamping said mainspring.

8. The method of manufacturing a drive element for a timepiece barrel according to claim 1, wherein said holding or hooking means for said mainspring is made in a form of a driving stop mechanism by a fold and/or by rolling said mainspring towards said touching-up axis at the inner end thereof.

9. The method of manufacturing a drive element for a timepiece barrel according to claim 1, wherein said mainspring is made with an eyelet at the inner end of said first inner coil, and wherein said step is re-machined in the shape of a hook conjugated with a housing and having a profile matching that of said eyelet.

10. The method of manufacturing a drive element for a timepiece barrel according to claim 1, wherein said snail-shaped profile has two substantially diametrically opposite flat portions relative to said touching-up axis, and wherein said mainspring is welded and/or brazed onto said arbor in an irreversible manner on at least two points of said flat portions.

11. The method of manufacturing a drive element for a timepiece barrel to claim 1, wherein said snail-shaped profile includes at least two flat portions for driving said arbor via a ratchet.

12. The method of manufacturing a drive element for a timepiece barrel according to claim 1, wherein at least one portion of said support sector of said mainspring is given a superficial roughness, greater than 12 Ra micrometers, in a form of a flute made during said wire drawing operation.

13. The method of manufacturing a drive element for a timepiece barrel according to claim 1, wherein at least one portion of said support sector of said mainspring is given a superficial roughness, greater than 12 Ra micrometers, in a form of a milled portion made during said wire drawing operation.

14. The method of manufacturing a drive element for a timepiece barrel according to claim 1, wherein said mainspring is pre-laminated in a differential manner, and wherein said first thickness of said first inner coil of said mainspring is smaller than thicknesses of following coils of said mainspring, which have a constant or progressive section moving away from said first inner coil.

15. The method of manufacturing a drive element for a timepiece barrel according to claim 1, wherein at least said inner end of said first inner coil of said mainspring is given a roughness of more than 12 Ra micrometers on an inner face thereof which will abut on a support sector of said arbor.

* * * * *